US005436705A

United States Patent [19]

Raj

[11] Patent Number: 5,436,705

[45] Date of Patent: Jul. 25, 1995

[54] ADAPTIVE PROCESS CONTROLLER FOR ELECTROPHOTOGRAPHIC PRINTING

[75] Inventor: Guru B. Raj, Fairport, N.Y.

[73] Assignee: Xerox Corporation, Stamford, Conn.

[21] Appl. No.: 228,787

[22] Filed: Apr. 18, 1994

[51] Int. Cl.[6] ..... G03G 21/14

[52] U.S. Cl. ..... 355/246; 355/208

[58] Field of Search ..... 355/246, 208, 245, 251, 355/259

[56] References Cited

U.S. PATENT DOCUMENTS

| | | | |
|---|---|---|---|
| 4,348,099 | 9/1982 | Fantozzi . | |
| 4,553,033 | 11/1985 | Hubble, III et al. | 250/353 |
| 4,965,634 | 10/1990 | Bando | 355/208 |
| 5,200,783 | 4/1993 | Maeda et al. | 355/246 |

*Primary Examiner*—R. L. Moses

[57] ABSTRACT

A adaptive process control apparatus for controlling a plurality of image parameters in an electrophotographic printing machine is disclosed. A toner area coverage sensor detects value of density values for a composite toner image representing a toner reproduction curve and generates a plurality of corresponding signals. A toner concentration sensor detects a level of toner concentration and generates a corresponding signal. The signals from both sensors are conveyed to a linear quadratic controller and compared to target image parameters, wherein control signals are generated based upon the difference between the two sets of inputs. An identifier also receives the signals generated by the sensors, along with the control signals corresponding to the difference between the two sets of inputs. The identifier then modifies the target images to compensate for changes in image quality due to material aging or environmental changes.

31 Claims, 3 Drawing Sheets

ADAPTIVE PROCESS CONTROLLER FOR ELECTROPHOTOGRAPHIC PRINTING

The present invention relates generally to an electrophotographic printing machine, and more particularly concerns an adaptive controller for regulating the printing process.

Typically, the electrophotographic process is controlled by adjusting the development field, cleaning field, exposure intensity, and toner concentration. An electrostatic voltmeter is used to measure the electrostatic fields. The electrostatic fields are adjusted successively to establish a desired operating range. Voluminous data is collected and analyzed to generate lookup tables in order to bring the density of an image, or more precisely the developed mass per unit area within prescribed limits. This approach significantly increases the cost of process control sensors. Furthermore, the process takes a long time to converge. In addition, during a product life cycle, conditions may change when compared to product development cycle assumptions, thereby degrading performance. Thus, new lookup tables may need to be provided as the characteristics of the photoreceptor, or other materials change.

Clearly, it would be highly desirable to automatically adjust time dependent process characteristics.

Other types of control systems for electrophotographic printing have been devised. The following disclosures may be relevant to various aspects of the present invention.

U.S. Pat. No. 4,348,099
Patentee: Fantozzi
Issued: Sep. 7, 1982
U.S. Pat. No. 4,553,033
Patentee: Hubble III et al.
Issued: Nov. 12, 1985
U.S. Pat. No. 5,416,564
Applicants: Thompson et al.
Filed: Feb. 4, 1994
U.S. Pat. No. 5,383,005
Applicants: Thompson et al.
Filed: Feb. 4, 1994

These disclosures may be briefly summarized as follows:

U.S. Pat. No. 4,348,099 discloses a control system for use in an electrophotographic printing machine. A charge control loop, an illumination control loop, a bias control loop, and a toner dispensing loop are provided. Test patches, an infrared densitometer, and an electrometer are used to measure charge level, exposure intensity, toner concentration, and developer bias. For the charge control loop, a D.C. electrometer senses the dark development potential of a photoconductive surface charged by a corona generating device. The electrometer transmits a corresponding electrical signal that is conveyed to a controller. The controller regulates a high voltage power supply connected to the corona generating charging device in order to maintain a constant dark development potential at the photoconductive surface. In exposure control, the electrometer transmits a signal generated to the controller that controls the exposure level on the photoconductive surface at a constant background potential. For bias control, an infrared densitometer is positioned adjacent to the photoconductive surface, between the developer station and the transfer station. The densitometer generates an electrical signal proportional to the toner mass of a solid area density test patch developed on the photoconductive surface. The signal is transmitted to the controller which regulates a power supply to control the electrical bias to the developer rolls in the developer housing. For automatic development control, the signal transmitted from the infrared densitometer is used to control central dispensing of toner from a toner cartridge to the developer material in the chamber of the developer housing.

U.S. Pat. No. 4,553,0033 discloses an infrared densitometer for measuring the density of toner particles on a photoconductive surface. A tonal test patch is projected by a test patch generator onto the photoconductive surface. The patch is then developed with toner particles. Infrared light is emitted from the densitometer and reflected back from the test patch. Control circuitry, associated with the densitometer, generates electrical signals proportional to the developer toner mass of the test patch.

U.S. Pat. No. 5,416,564 and U.S. Pat. No. 5,383,005 disclose a current sensing device that generates electrical signals proportional to the current flow between the photoconductive surface and a development station as toner is applied to the photoconductive surface at predetermined regions or patches. A charging device is controlled in response to the generated signals.

Pursuant to the features of the present invention, there is provided an apparatus for controlling parameters of processing stations in a printing machine having a surface with a variable density image developed thereon and including: a sensor for detecting densities of the variable density image developed on the surface and transmitting signals indicative thereof; an updater, in communication with said sensor, for generating correction signals in response to the signals transmitted thereto from said sensor; and a controller, responsive to the signals from said sensor and the correction signals from said updater, for transmitting control signals to the processing stations to regulate the processing stations.

In accordance with another aspect of the present invention, there is provided an electrophotographic printing machine of the type having processing stations and a photoconductive member with a solid area density region, a half-tone density region and a highlight density region developed thereon, wherein the improvement includes: a sensor for detecting densities of the solid area density region, half-tone density region and highlight density region developed on the photoconductive member and transmitting a solid area density signal, a half-tone density signal and a highlight density signal indicative of the solid area density region, half-tone density region and highlight density region; an updater, in communication with said sensor, for generating a solid area density correction signal, a half-tone density correction signal and a highlight density correction signal in response to the solid area density signal, half-tone density signal and highlight density signal transmitted thereto from said sensor; and a controller, responsive to the solid area density signal, half-tone density signal and highlight density signal from said sensor and the solid area density correction signal, half-tone density correction signal and highlight density correction signal from said updater, for transmitting control signals to the processing stations to regulate the processing stations.

In accordance with yet another aspect of the present invention, there is provided a method of controlling parameters of processing stations in a printing machine having a photoconductive surface with a variable density image developed thereon, including the steps of: detecting densities of the variable density image developed on the photoconductive surface and transmitting density signals indicative thereof; generating correction signals in response to the density signals transmitted thereto; and transmitting control signals, in response to the density signals and the correction signals, to the processing stations to regulate the processing stations.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
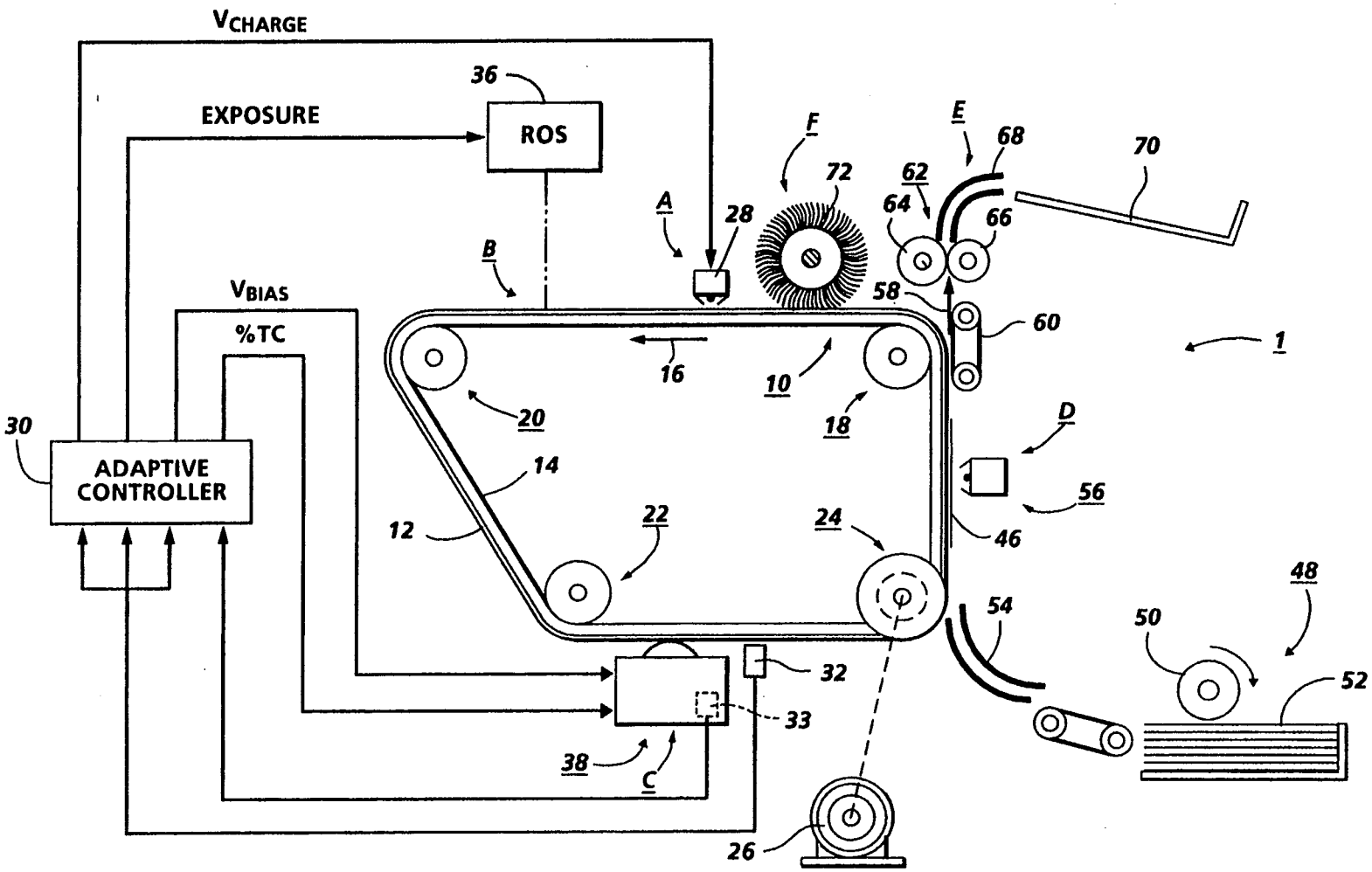
FIG. 1 is a schematic, elevational view showing an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the adaptive control system of the present invention therein. It will become evident from the following discussion that this control system is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter and their operation described briefly with reference thereto.

Turning to FIG. 1, the electrophotographic printing machine 1 employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22, 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, a Raster Input Scanner (RIS) and a Raster Output Scanner (ROS) are used to expose the charged portions of photoconductive surface 12 to record an electrostatic latent image thereon. The RIS (not shown), contains document illumination lamps, optics, a mechanical scanning mechanism and photosensing elements such as charged couple device (CCD) arrays. The RIS captures the entire image from the original document and converts it to a series of raster scan lines. These raster scan lines are transmitted from the RIS to a ROS 36. ROS 36 illuminates the charged portion of photoconductive surface 12 with a series of horizontal lines with each line having a specific number of pixels per inch. These lines illuminate the charged portion of the photoconductive surface 12 to selectively discharge the charge thereon. An exemplary ROS 36 has lasers with rotating polygon mirror blocks, solid state modulator bars and mirrors. Still another type of exposure system would merely utilize a ROS 36 with the ROS 36 being controlled by the output from an electronic subsystem (ESS) which prepares and manages the image data flow between a computer and the ROS 36. The ESS (not shown) is the control electronics for the ROS 36 and may be a self-contained, dedicated minicomputer. Thereafter, belt 10 advances the electrostatic latent image recorded on photoconductive surface 12 to development station C.

One skilled in the art will appreciate that a light lens system may be used instead of the RIS/ROS system heretofore described. An original document may be positioned face down upon a transparent platen. Lamps would flash light rays onto the original document. The light rays reflected from original document are transmitted through a lens forming a light image thereof. The lens focuses the light image onto the charged portion of photoconductive surface to selectively dissipate the charge thereon. This records an electrostatic latent image on the photoconductive surface which corresponds to the informational areas contained within the original document disposed upon the transparent platen.

At development station C, a magnetic brush developer system, indicated generally by the reference numeral 38, transports developer material comprising carrier granules having toner particles adhering triboelectrically thereto into contact with the electrostatic latent image recorded on photoconductive surface 12. Toner particles are attracted from the carrier granules to the latent image forming a powder image on photoconductive surface 12 of belt 10.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the uppermost sheet of a stack of sheets 52. Feed roll 50 rotates to advance the uppermost sheet from stack 50 into sheet chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 driven by a motor and a backup roller 66. Sheet 46 passes between fuser roller 64 and backup roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted fibrous brush 72 in contact with photoconductive surface 12. The preclean corona generator neutralizes the charge attracting the particles to the photoconductive surface. These particles are cleaned from the photoconductive surface by the rotation of brush 72 in contact therewith. One skilled in the art will appreciate that other cleaning means may be used such as a blade cleaner. Subsequent to cleaning, a discharge lamp (not shown) floods photoconductive surface 12 with light to dissipate any residual charge remaining thereon prior to the charging thereof for the next successive imaging cycle.

In order to maintain image quality and compensate for copy to copy density variations, there is provided an adaptive controller 30 that controls the tonal reproduction curve. Controller 30 adjusts compensation filters in real time to control parameter variations. Controller 30 divides the adaptive control into two tasks, parameter identification and control modification. The estimated results are used to modify the compensation parameters.

Figure 2:
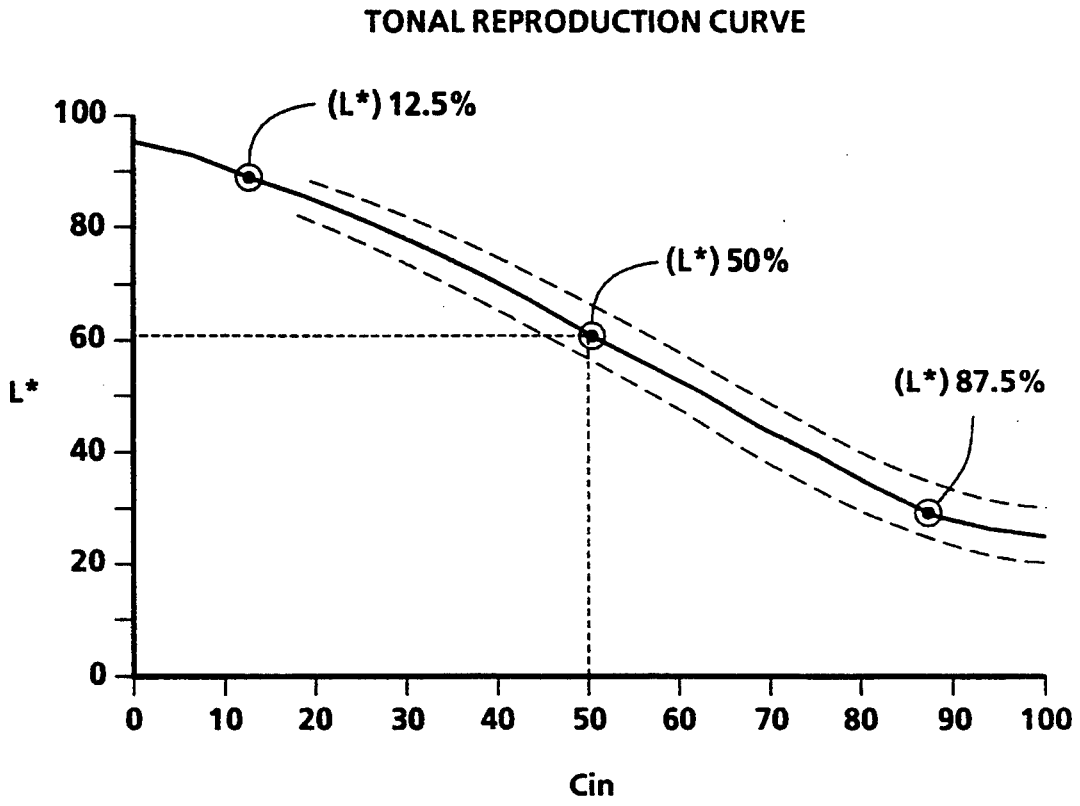
FIG. 2 is a graph showing a Tonal Reproduction Curve.

A nominal tonal reproduction curve is illustrated in FIG. 2. Tonal reproduction curve control provides uniform gray scale development and effective translation of halftones, highlights, and shadow details, as well as mid-tone densities. The control stability of all the density levels on the tonal reproduction curve make photographic reproductions and other halftone documents invariant from machine to machine and copy to copy. Referring to FIG. 2, a tonal reproduction curve is shown in terms of a measure of whiteness (L*) versus the toner area coverage (Cin) of developed image fill patterns. L* represents the differential response of the human eye to a developed image and is used as a metric for density variation. Since L* is non-linear in terms of density, density information for values of Cin are converted to L* units by the formula:

$$L^* = 116(\text{Density})^{\frac{1}{3}} - 16$$

where:

Density is a developed toner mass value measured by a laboratory grade densitometer during the design phase of the printing machine.

L* verus Cin process control targets are defined based upon statistical experiments performed during the design phase of the printing machine. A L* to relative reflectance correlation is accomplished using experimental data to generate relative reflectance targets that correspond to given L * values. The relative reflectance (RR) targets are then embedded as a lookup table in the machine software. Three process control targets are illustrated in FIG. 2. The targets include L*−Cin values for highlight density, halftone density, and solid area density. The targets are labeled (L*)12.5%, (L*)50% and (L*)87.5% respectively. Corresponding RR targets such as $RR_{12.5}$, $RR_{50}$, and $RR_{87.5}$ are stored in a machine software lookup table.

Variations in the L* values shown in FIG. 2 are controlled to a standard deviation of plus or minus 2 units or 2 sigma-limits. The standard deviation is indicated graphically, in FIG. 2, by a space defined between two opposing dotted lines adjacent to the tonal reproduction curve. For example, the standard deviation for the majority of L* corresponding to a Cin density of 50% should lie, as shown, in a range of 60±4, or 56 to 64 units.

In FIG. 1, state variables such as charge voltage ($V_{CHARGE}$), developer bias voltage ($V_{BIAS}$), exposure intensity (EXPOSURE), and toner concentration (% TC) are used as actuators to control the tonal reproduction curve of FIG. 2. Changes in output generated by the adaptive controller 30 are measured by a toner area coverage (TAC) sensor 32 and a toner concentration (TC) sensor 33. TAC sensor 32, which is located after development station C, measures the developed toner mass for different area coverage patches recorded on the photoconductive surface 12. TC sensor 33, which is located in the magnetic brush developer system 38 measures toner concentration inside the housing. Control algorithms for a Linear Quadratic Controller and a Parameter Identifier, discussed hereinafter with reference to FIG. 4, process this information to continually adjust exposure, development potential, development bias, and toner concentration to maintain the process within a specified operating latitude that assures acceptable image quality.

A low sensitivity toner sensor manufactured by the TDK ® Corp., such as the TDK ® Model No. TS 1015 is used for TC sensor 33. Referring to FIG. 1, TC sensor 33 measures the magnetic field of the developer material comprised of carrier granules (magnetic powder) and toner particles (pigment powder) mixed proportionally to create the developer housed in the developer system 38. Carrier granules possess a high degree of permeability to support a magnetic flux density while toner is a lower permeability material. The combined permeability generates a signal which is transmitted to controller 30. TC Sensor 33 is part of a toner concentration feedback loop using a separate Proportional/Integral (PI) controller for dispensing toner. The PI controller is internal to controller 30 and will be discussed in further detail with reference to FIG. 4.

The manner of operation of the TAC sensor 32, shown in FIG. 1, is described in U.S. Pat. No. 4,553,033 to Hubble III et al., which is hereby incorporated in its entirety into the instant disclosure. TAC sensor 32, is an infrared reflectance type densitometer that measures the density of toner particles developed on the photoconductive the surface 12.

Figure 3:
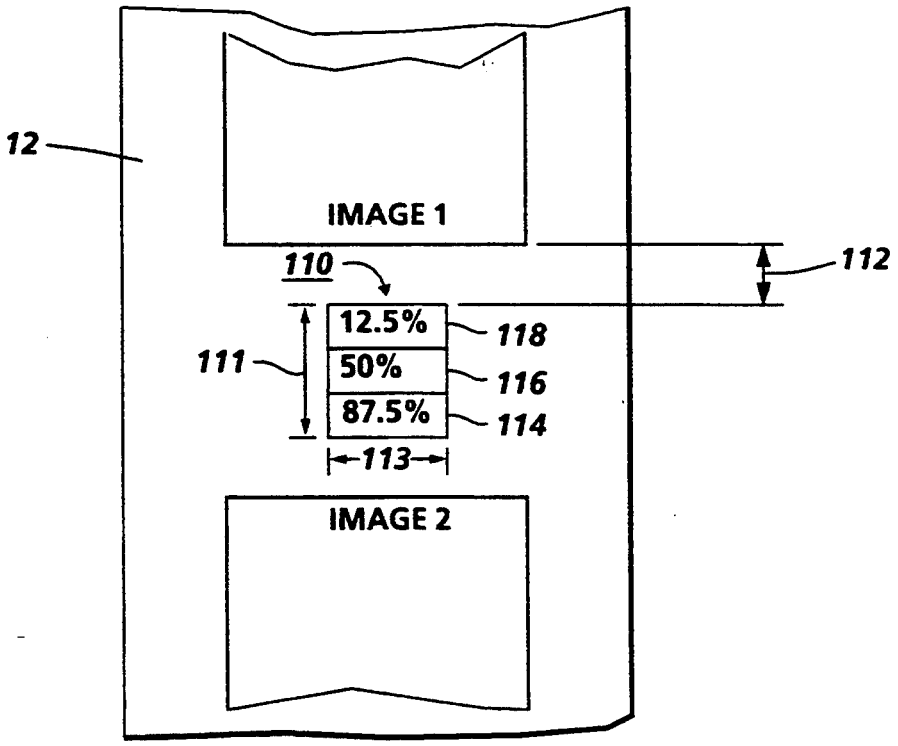
FIG. 3 shows the target area interposed between adjacent images recorded on the photoconductive member.

Referring to FIG. 3, a composite toner test patch 110 is imaged in the interdocument area of photoconductive surface 12. The photoconductive surface 12 is illustrated as containing two documents images: image 1 and image 2. The test patch 110 is shown in the interdocument space between image 1 and image 2 and is that portion of the photoconductive surface 12 sensed by the TAC sensor 32 to provide the necessary signals for control. The composite patch 110 measures 15 millimeters, in the process direction, indicated by arrow 111 and 45 millimeters, in the cross process direction, indicated by arrow 113. Patch 110 consists of a segment 114 for solid area density (87.5%), a segment 116 for halftone density (50%), and a segment 118 for highlight density (12.5%). Before the TAC sensor 32 can provide a meaningful response to the relative reflectance of patch segments 114, 116, and 118, the TAC sensor 32 must be calibrated by measuring the light reflected from a bare or clean area portion 112 of photoconductive belt surface 12. For calibration purposes, current to the light emitting diode (LED) internal to the TAC sensor 32 is increased until the voltage generated by the TAC sensor 32 in response to light reflected from the bare or clean area 112 is between 3 and 5 volts.

Referring to FIG. 1 and FIG. 3, bit patterns for the composite patch 110 are computer generated during the design stage of the machine. The bit patterns are downloaded to an electrical programmable read only memory (EPROM) contained in the video module (Not Shown) of the ROS 36. The composite patch is imaged in the interdocument zone of photoconductive surface 12 by the ROS 36 at a rate of one patch per revolution of photoconductive surface 12. The video module sends the bit pattern information to ROS 36. The ROS 36 changes exposure intensity pixel by pixel, so that the intensity variation of the individual pixels correspondingly changes the discharge potential on the photoconductive surface 12 and forms a latent image of the segments comprising the composite patch 110. As the photoconductive surface 12 passes the development station C, the latent image is developed with toner material. After development, the TAC sensor 32 detects the intensity of the light reflected from the clean area 112 of the photoconductive surface 12 and each toned area segment 114, 116, and 118 three times. The change in reflectance between the clean area 112 and each toned segment of the composite patch 110 forms a relative reflectance reading that is a measure of the developed toner mass for each segment of the composite test patch 110. Readings generated by the TAC 32 sensor are then transmitted to the adaptive controller 32.

Differences in developability cause the same development voltage to result in different developed masses per unit area. Variations in developability may have a number of sources, but principle among them are triboelectric variations and developer roll to photoconductive surface spacing. The actuator for controlling developability is the peak-to-peak AC voltage on the developer roll. The TAC sensor 32 is used to acquire an approximation of developability and then adjust the developer voltage until developability is within an acceptable standard deviation on the tonal reproduction curve shown in FIG. 2.

To optimize the Cin−L* standard deviation space on the tonal reproduction curve, the TAC sensor 32 is used, as discussed with reference to FIG. 1, to measure the relative reflectance of patch segments shown in FIG. 3. Since there is a correlation between the relative reflectance of the developed toner mass for different area coverage patches recorded on the photoconductive surface, to the L* or differential response of the human eye, the TAC sensor 32 measurement is used as a surrogate for a Cin measurement. Differences between the actual toner reproduction curve and the nominal curve are then reduced by new actuator commands issued to the electrophotographic printing by the controller 30, shown in FIG. 1, to adjust exposure, charge, and developer bias. Optimization of the Cin−L* space is proceeded by the first two steps of the process setup for two reasons: First, the TAC sensor 32 must be calibrated before it can be used. Second, without the developability control, Cin−L* optimization may cause the charge potential to vary widely from setup to setup in order to compensate for differences in developability.

Developability control through the use of the adaptive controller is obtained by measuring density and using an appropriate filtering algorithm to filter out noise components to arrive at a true signal. The filtered density value is compared to a density target value stored in the machine memory. Toner concentration as well the developer potential are adjusted through a toner concentration control loop and a developer bias voltage. The adaptive controller uses an autoregressive moving average model (ARMA) algorithm with disturbance inputs. ARMA is a linearized perturbation model around the operating region of the tonal reproduction curve and is represented in matrix notation by:

$$Y(t)=\theta^T(t)\phi(t)+\psi(t)$$

where:

Y represents the output vector, $\theta$ represents the unknown parameter matrix, $\phi$ represents the known input signal vector, and $\psi$ represents a noise vector.

The unknown parameters denoted by $\theta$ represent the sensitivity of L* with reference to the actuators. Nominal values for the unknown parameter matrix $\theta$ are derived during the machine design stage and embedded in the machine software. The L* levels derived from measurements of the composite test patch vary with changes in the actuator levels and also, with the presence of process noise. Process noise stems from the change in material charging characteristics which are influenced by relative humidity, temperature, and throughput of the developer material from the developer to the photoconductive surface. Another source of noise is arises from changes in the discharge characteristic of the photoconductive surface which is influenced by age, temperature, and relative humidity.

In expanded form, the matrix is represented by:

$$\begin{pmatrix} \delta L^*_{SA} \\ \delta L^*_{HT} \\ \delta L^*_{HL} \end{pmatrix} = \begin{pmatrix} \theta 11(t)\ \theta 12(t)\ \theta 13(t)\ \theta 14(t) \\ \theta 21(t)\ \theta 22(t)\ \theta 23(t)\ \theta 24(t) \\ \theta 31(t)\ \theta 32(t)\ \theta 33(t)\ \theta 34(t) \end{pmatrix} \begin{pmatrix} \delta V_{charge} \\ \delta V_{bias} \\ \delta \text{Exposure} \\ \delta TC \end{pmatrix} + \begin{pmatrix} \xi 1 \\ \xi 2 \\ \xi 3 \end{pmatrix}$$

where:

$\delta L^*_{SA}$ is an individual term of the output vector Y and is equal to the error value of the differential response of the human eye to a solid area test patch, $\delta L^*_{HT}$ is an individual term of the output vector Y and is equal to the error value of the differential response of the human eye to a halftone test patch, $\delta L^*_{HL}$ is an individual term of the output vector Y and is equal to the error value of the differential response of the human eye to a highlight test patch, $\theta 11(t)$ $\theta 12(t)$, $\theta 13(t)$, $\theta 14(t)$, $\theta 21(t)$, $\theta 22(t)$, $\theta 23(t)$, $\theta 24(t)$, $\theta 31(t)$, $\theta 32(t)$, $\theta 33(t)$, $\theta 34(t)$, are individual terms of the unknown parameter matrix $\theta$, $\delta V_{charge}$ is an individual term of the known input signal vector $\phi$ and is equal the change in charge potential, $\delta V_{bias}$ is an individual term of the known input signal vector $\phi$ and is equal to the change in development potential, $\delta$Exposure is an individual term of the known input signal vector $\phi$ and is equal to the change in exposure intensity, $\delta$TC is an individual term of the known input signal vector $\phi$ and is equal to the change in toner concentration, $\xi 1$, $\xi 2$, and $\xi 3$ are individual terms of the noise vector $\psi$.

Figure 4:
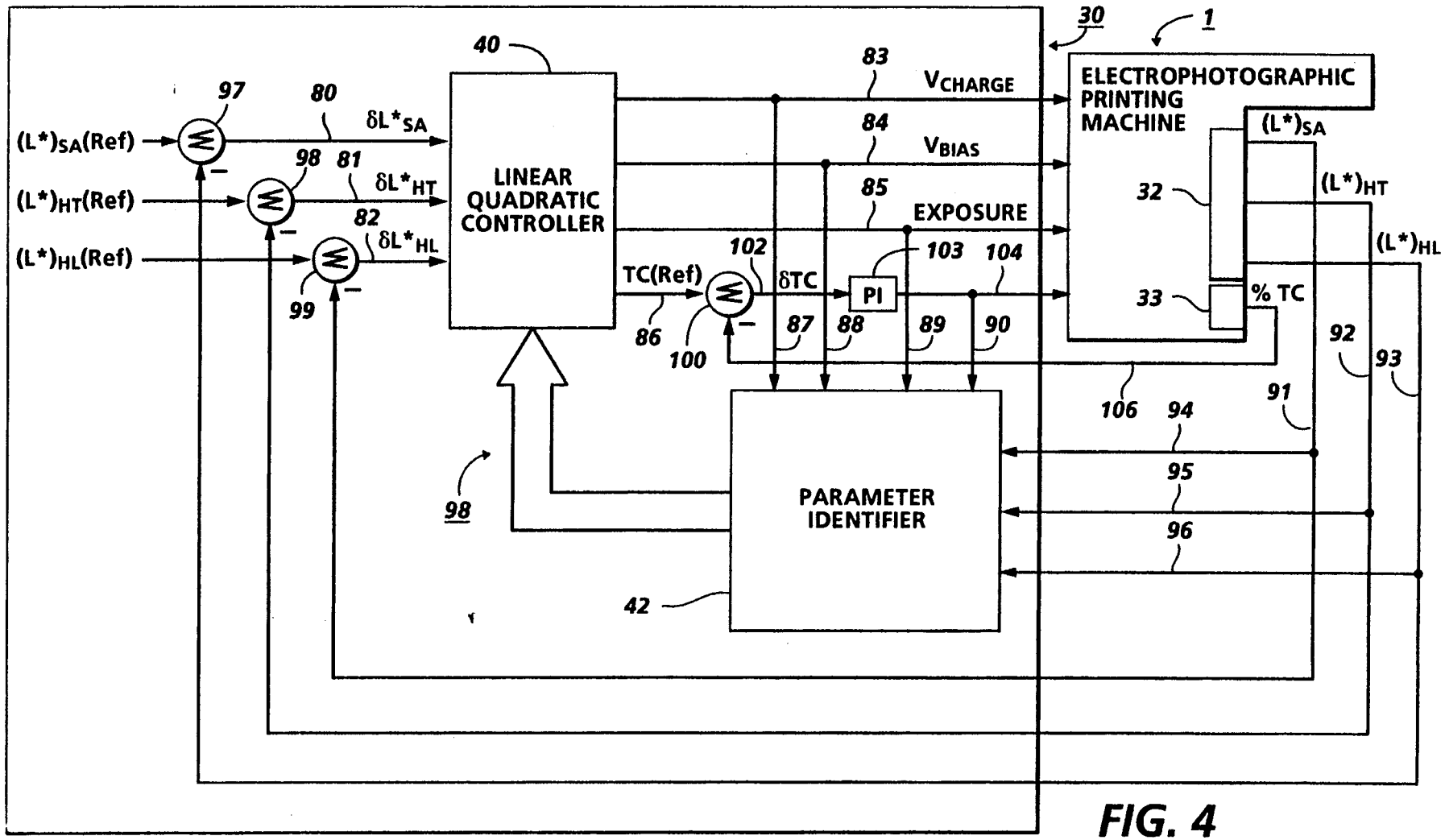
FIG. 4 is a block diagram of the adaptive controller used in the FIG. 1 printing machine.

Turning now to FIG. 4, the controller 30 has three components, a parameter identifier 42 and a linear quadratic controller 40, and a Proportional Integral (PI) controller 103. The output parameters from the controller 40 include charge potential ($V_{CHARGE}$), development potential ($V_{BIAS}$), exposure intensity (EXPOSURE), and a toner reference signal TC(Ref). With the exception of TC(Ref), The signal are the inputs actuators for the electrophotographic printing machine 1 and are connected to the electrophotographic printing machine 1 by signal lines 83, 84, and 85. Signal outputs from the electrophotographic printing machine 1 are measured by the TAC sensor 32. The TAC 32 sensor readings are enabled at the photoconductive belt interdocument zone, during proper intervals based upon the machine timing of electrophotographic printing machine 1. As discussed previously with reference to FIG. 3, a TAC sensor reading from a clean photoconductive surface is compared with the toned area of the composite test patch. The relative reflectance for each segment of the composite test patch $(L^*)_{SA}$, $(L^*)_{HT}$, and $(L^*)_{HL}$ is computed and conveyed by output lines 91, 92, and 93 to corresponding summing points 97, 98, and 99. The computed relative reflectance values for $(L^*)_{SA}$, $(L^*)_{HT}$, and $(L^*)_{HL}$ are compared to target values $(L^*)_{SA}$(Ref), $(L^*)_{HT}$(Ref), and $(L^*)_{HL}$(Ref) at summing points 97, 98, and 99 from which error values $\delta L^*_{SA}$, $\delta L^*_{HT}$, and $\delta L^*_{HL}$ are generated. The error values are transmitted to the Linear Quadratic Controller 40 by input lines 80, 81, and 82. The Linear Quadratic Controller 40 computes new values for the next actuator levels. The Linear Quadratic Controller 40 minimizes the sum of the squares of the error values and also, the sum of the squares of the actuator movements with an objective factor:

$$J=\Sigma(w_1e^2_{SA}+w_2e^2_{HT}+w_3e^2_{HL})$$

where:

w1, w2, and w3 are weights associated with respective solid area, halftone, and highlight value, and $e_{SA}$, $e_{HT}$, and $e_{HL}$ are respectively, the errors in the solid area, halftone, and highlight values read from the composite test patch.

The sum of the squares of actuator movements is included to dampen the excursions of the actuators and make the operation of the Linear Quadratic Controller 40 robust in the presence of noise.

The new actuator commands are conveyed to the electrophotographic printing machine 1 by conductors 83, 84, and 85. Corresponding adjustments are automatically made to the corona charging device, the developer bias control, and the ROS exposure level so as to match the new actuator values. The process repeats for every revolution of the photoconductive belt in order to adjust image quality to the specified targets.

The control of toner concentration is accomplished by a Proportional/Integral (PI) controller 103 that operates once every second of machine operation. Controller 40 generates an output toner concentration reference signal TC(Ref), on signal line 86. The TC(Ref) signal is transmitted to one input of summing point 100. Toner sensor 33 generates a % TC signal corresponding to the percentage of toner concentration contained in the development system 38 of electrophotographic printing machine 1. The output % TC signal is transmitted to a second input of summing point 100, via signal line 106. Summing point 100 determines an error value $\delta$TC which is the difference between the TC set point TC(Ref), generated by controller 40 and the toner concentration % TC, sensed by toner sensor 33. Error value $\delta$TC, is transmitted to controller PI 103, by signal line 102 where an algorithm computes the amount of toner concentration for the next toner dispenser actuation. The algorithm for dispensing toner is:

$$\text{Dispenser Action}=K_P e(t)+K_I \int e(t)$$

where:

$K_P$ is a proportional constant stored the machine memory, $K_I$ is an integral constant stored in the machine memory, e is the error value $\delta$TC determined by the summing point, and t is iteration number of e.

When TC sensor 33 generates a signal corresponding to either a low toner or high toner concentration, the PI controller 103 correspondingly actuates the toner dispenser (Not Shown) in development system 38, via signal line 104 to add toner to the developer housing of the developer system 38 to increase toner concentration or de-energize to decrease toner concentration.

As the photoconductor and developer materials age, or the machine environment changes, there are corresponding changes to the sensitivity of the L* parameters. If the ARMA perturbation model is not frequently updated, the performance of controller 30 degrades. The software operating in electrophotographic printing machine 1 generates actuator commands and processes corresponding information measured by TAC sensor 32 and toner sensor 33. Hence, the machine software already has input and output information pertinent to the transactions completed between the linear quadratic controller 40 and electrophotographic printing machine 1. The same information is periodically presented to the parameter identifier 42. For example, the actuator input levels corresponding to charge potential ($V_{CHARGE}$), development potential ($V_{BIAS}$), exposure intensity (EXPOSURE), and % TC are conveyed to the parameter identifier 42 via signal lines 87,88, 89, and 90. Likewise, the output relative reflectance values for $(L^*)_{SA}$, $(L^*)_{HT}$, and $(L^*)_{HL}$ are conveyed to the parameter identifier 42 via signal lines 94, 95, and 96. Parameter identifier 42, in turn, computes a new set of unknown parameters for the $\theta$ matrix in the ARMA perturbation model. Parameter identification is accomplished by the means of a recursive least squares technique. The updated parameters are sent to the Linear Quadratic Controller 40 by the way of a data bus 98, once every third revolution of the photoconductive belt, so as to upgrade the ARMA perturbation model and enable controller 40 to compute $V_{CHARGE}$, $V_{BIAS}$, EXPOSURE, and TC(Ref) as a function of $\delta L^*_{SA}$, $\delta L^*_{HT}$, and $\delta L^*_{HL}$, % TC.

In recapitulation, it is clear that the apparatus of the present invention includes an adaptive controller for controlling a plurality of process parameters in an electrophotographic printing machine. A toner area coverage sensor detects a plurality of density values for a toner image and generates corresponding signals. A toner concentration sensor detects a level of toner concentration and generates a corresponding signal. A controller is adapted to receive the signals from the toner area coverage sensor and the toner concentration sensor and generates a set of control signals indicative thereof. An identifier is adapted to receive the same signals generated by the sensors and modifies the control parameters of the controller.

It is, therefore, evident that there has been provided, in accordance with the present invention, an adaptive controller that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which may fall within the spirit and broad scope of the appended claims.

I claim:

1. An apparatus for controlling parameters of processing stations in a printing machine having a surface with a variable density image developed thereon, including:

a sensor for detecting densities of the variable density image developed on the surface and transmitting signals indicative thereof;

an updater, in communication with said sensor, for generating correction signals in response to the signals transmitted thereto from said sensor; and a controller, responsive to the signals from said sensor and the correction signals from said updater, for transmitting control signals to the processing stations to regulate the processing stations.

2. An apparatus according to claim 1 wherein one of the processing stations comprises a developer unit having a mixture of toner particles and carrier granules therein, and a dispenser for discharging toner particles into the developer unit, further including:

a detector for measuring toner particle concentration in the developer unit and transmitting a concentration signal indicative thereof, said controller transmitting a reference concentration signal; and a concentration controller, responsive to the reference concentration signal from said controller and the concentration signal from said detector, for transmitting a concentration control signal to the dispenser to regulate discharging of toner particles into the developer unit.

3. An apparatus according to claim 2, wherein said updater, responsive to the signal from said concentration controller, transmits a concentration correction signal to said controller to correct the reference concentration signal from said controller.

4. An apparatus according to claim 3, wherein said controller includes:

means, responsive to reference signals and the signals from said first mentioned sensor, for generating error signals; and means, responsive to the error signals and the correction signals, for generating the control signals and the reference concentration signal.

5. An apparatus according to claim 4, wherein said concentration controller includes a proportional integral controller.

6. An apparatus according to claim 5, wherein said updater includes means for calculating the correction signals by using a linearized perturbation model.

7. An apparatus according to claim 6, wherein said control signal generating means includes means for calculating the error signals by minimizing the sum of the squares of the error signals.

8. An apparatus according to claim 1, wherein one of the processing stations comprises a developer unit having an electrical bias applied thereon, said controller transmitting as the control signal a signal to adjust the electrical bias being applied on said developer unit.

9. An apparatus according to claim 1, wherein one of the processing stations comprises an exposure station adapted to illuminate the surface with light rays of a selected intensity, said controller transmitting as the control signal a signal to adjust the exposure station to control the intensity of the light rays.

10. An apparatus according to claim 1, wherein one of the processing stations comprises a charging station adapted to charge the surface, said controller transmitting as the control signal a signal to adjust said charging station to control the charge on the surface.

11. An apparatus according to claim 1, wherein the variable density image developed on the surface includes a solid area density region, a half-tone density region and a highlight density region,

12. An electrophotographic printing machine of the type having processing stations and a photoconductive member with a solid area density region, a half-tone density region and a highlight density region developed thereon, wherein the improvement includes:

a sensor for detecting densities of the solid area density region, half-tone density region and highlight density region developed on the photoconductive member and transmitting a solid area density signal, a half-tone density signal and a highlight density signal indicative of the solid area density region, half-tone density region and highlight density region;

an updater, in communication with said sensor, for generating a solid area density correction signal, a half-tone density correction signal and a highlight density correction signal in response to the solid area density signal, half-tone density signal and highlight density signal transmitted thereto from said sensor; and a controller, responsive to the solid area density signal, halftone density signal and highlight density signal from said sensor and the solid area density correction signal, half-tone density correction signal and highlight density correction signal from said updater, for transmitting control signals to the processing stations to regulate the processing stations.

13. A printing machine according to claim 12 wherein one of the processing stations comprises a developer unit having a mixture of toner particles and carrier granules therein, and a dispenser for discharging toner particles into the developer unit, further including:

a detector for measuring toner particle concentration in the developer unit and transmitting a concentration signal indicative thereof, said controller transmitting a reference concentration signal; and a concentration controller, responsive to the reference concentration signal from said controller and the concentration signal from said detector, for transmitting a concentration control signal to the dispenser to regulate discharging of toner particles in the developer unit.

14. A printing machine according to claim 13, wherein said updater, responsive to the signal from said concentration controller, transmits a concentration correction signal to said controller to correct the reference concentration signal from said controller.

15. A printing machine according to claim 14, wherein said controller includes:

means, responsive to a solid area density reference signal, a half-tone density reference signal and a highlight density reference signal and the solid area density signal, half-tone density signal and highlight density signal from said first mentioned sensor, for generating a solid area density error signal, a half-tone density error signal and a highlight density error signal; and means, responsive to the solid area density error signal, half-tone density error signal and highlight density error signal and the solid area density correction signal, half-tone density correction signal, highlight density correction signal, and concentration correction signal, for generating the control signals and the reference concentration signal.

16. A printing machine according to claim 15, wherein said concentration controller includes a proportional integral controller.

17. A printing machine according to claim 16, wherein said updater includes means for calculating the solid area density correction signal, half-tone density correction signal, highlight density area correction signal, and concentration correction signal by using a linearized perturbation model.

18. A printing machines according to claim 17, wherein said control signal generating means includes means for calculating the solid area density error signal, half-tone density error signal and highlight density error signal by minimizing the sum of the squares of the solid area density error signal, half-tone density error signal and highlight density error signal.

19. A printing machine according to claim 12, wherein one of the processing stations comprises a developer unit having an electrical bias applied thereon, said controller transmitting as the control signal a signal to adjust the electrical bias being applied on said developer unit.

20. A printing machine according to claim 12, wherein one of the processing stations comprises an exposure station adapted to illuminate the photoconductive member with light rays of a selected intensity, said controller transmitting as the control signal a signal to adjust the exposure station to control the intensity of the light rays.

21. A printing machine according to claim 12, wherein one of the processing stations comprises a charging station adapted to charge the photoconductive member, said controller transmitting as the control signal a signal to adjust said charging station to control the charge on the photoconductive member.

22. A method of controlling parameters of processing stations in a printing machine having a photoconductive surface with a variable density image developed thereon, including the steps of:

detecting densities of the variable density image developed on the photoconductive surface and transmitting density signals indicative thereof;

generating correction signals in response to the density signals transmitted thereto; and transmitting control signals, in response to the density signals and the correction signals, to the processing stations to regulate the processing stations.

23. A method according to claim 22 wherein one of the processing stations comprises a developer unit having a mixture of toner particles and carrier granules therein, and a dispenser for discharging toner particles into the developer unit, further including the steps of:

measuring toner particle concentration in the developer unit and transmitting a concentration signal indicative thereof; and transmitting, in response to a reference concentration signal and the concentration signal, a concentration control signal to the dispenser to regulate discharging of toner particles into the developer unit.

24. A method according to claim 23, wherein said step of transmitting control signals includes the step of transmitting a concentration correction signal to said controller to correct the reference concentration signal.

25. A method according to claim 24, said step of transmitting control signals includes the steps of:

generating, responsive to reference signals and the density signals, error signals; and generating, responsive to the error signals and the correction signals, the control signals and the reference concentration signal.

26. A method according to claim 25, wherein said step of generating correction signals includes the step of calculating the correction signals by using a linearized perturbation model.

27. A method according to claim 26, wherein said step of transmitting control signals includes the step of calculating the error signals by minimizing the sum of the squares of the error signals.

28. A method according to claim 22, wherein one of the processing stations comprises a developer unit having an electrical bias applied thereon, said step of transmitting control signals including the step of transmitting a signal to adjust the electrical bias being applied on the developer unit.

29. A method according to claim 22, wherein one of the processing stations comprises an exposure station adapted to illuminate the photoconductive surface with light rays of a selected intensity, said step of transmitting control signals including the step of transmitting a signal to adjust the exposure station to control the intensity of the light rays.

30. A method according to claim 22, wherein one of the processing stations comprises a charging station adapted to charge the surface, and wherein said step of transmitting control signals includes the step of transmitting a signal to adjust the charging station to control the charge on the photoconductive surface.

31. A method according to claim 22, further including a step of forming on the photoconductive surface the variable density image with a solid area density region, a half-tone density region and a highlight density region.

* * * * *